US010575624B2

(12) United States Patent
Davis, Jr.

(10) Patent No.: US 10,575,624 B2
(45) Date of Patent: Mar. 3, 2020

(54) RECREATIONAL BOARD CARRIER

(76) Inventor: John Jay Davis, Jr., Culver City, CA (US)

( * ) Notice: Subject to any disclaimer, the term of this patent is extended or adjusted under 35 U.S.C. 154(b) by 775 days.

(21) Appl. No.: 13/486,100

(22) Filed: Jun. 1, 2012

(65) Prior Publication Data

US 2013/0043291 A1 Feb. 21, 2013

Related U.S. Application Data

(60) Provisional application No. 61/525,550, filed on Aug. 19, 2011.

(51) Int. Cl.

| | |
|---|---|
| ***A45F 3/14*** | (2006.01) |
| ***A45F 3/15*** | (2006.01) |
| ***A45F 3/04*** | (2006.01) |
| *A45F 3/00* | (2006.01) |

(52) U.S. Cl.

CPC ..... *A45F 3/15* (2013.01); *A45F 3/04* (2013.01); *A45F 2003/003* (2013.01); *A45F 2003/142* (2013.01)

(58) Field of Classification Search

CPC .. A45F 3/04; A45F 3/042; A45F 3/047; A45F 3/06; A45F 3/08; A45F 2003/146; A45F 2200/0566; A45F 3/00; A45F 2004/006; A45F 3/14; B63B 35/7946; A63C 11/02; A63C 35/7946

USPC ..... 224/627, 257, 258, 250, 272, 600, 917, 224/153, 580, 651, 916, 200, 259, 609; 294/147

See application file for complete search history.

(56) References Cited

U.S. PATENT DOCUMENTS

| | | | | |
|---|---|---|---|---|
| 4,114,838 | A * | 9/1978 | Knauf | 294/157 |
| 4,261,493 | A * | 4/1981 | Newman | 224/257 |
| 4,518,107 | A | 5/1985 | Amos | |
| 4,793,535 | A | 12/1988 | Johnson | |
| 4,878,585 | A | 11/1989 | Orestano | |
| 5,083,692 | A | 1/1992 | Trese | |
| 5,107,995 | A * | 4/1992 | Simpson | 211/60.1 |
| 5,383,587 | A | 1/1995 | Carpenter | |
| 5,492,254 | A | 2/1996 | Challoner et al. | |
| 5,746,361 | A | 5/1998 | Johnson | |
| 5,803,332 | A | 9/1998 | Thompson | |

(Continued)

FOREIGN PATENT DOCUMENTS

| | | |
|---|---|---|
| AU | 2004237831 A1 | 6/2005 |
| FR | 2 688 458 A1 | 9/1993 |

OTHER PUBLICATIONS

The International Search Report and the Written Opinion of the International Searching Authority, dated Apr. 16, 2014, for International Application No. PCT/US13/76070, filing date, Dec. 18, 2013.

(Continued)

*Primary Examiner* — Nathan J Newhouse
*Assistant Examiner* — Matthew T Theis
(74) *Attorney, Agent, or Firm* — Hackler Daghighian Martino & Novak

(57) ABSTRACT

A recreational board carrier. The carrier can include a central portion, at least one longitudinal strap coupled to the central portion and extending therefrom, a coupler disposed at a distal end of the longitudinal strap, the coupler adapted to couple to a first end of a recreational board, a plurality of apertures defined in the longitudinal strap, and at least one carrying strap coupled to the central portion.

25 Claims, 12 Drawing Sheets

(56) References Cited

U.S. PATENT DOCUMENTS

| | | | | |
|---|---|---|---|---|
| 6,010,051 | A | 1/2000 | Callanan | |
| 6,179,186 | B1 | 1/2001 | Blanking | |
| 6,681,968 | B2 | 1/2004 | Zwagerman | |
| 6,799,707 | B2 | 10/2004 | Gibson | |
| 2005/0061844 | A1 | 3/2005 | Haro | |
| 2006/0076378 | A1* | 4/2006 | Hall | 224/257 |
| 2006/0273534 | A1 | 12/2006 | Turner et al. | |
| 2008/0185409 | A1 | 8/2008 | Kellenberger | |
| 2010/0089959 | A1* | 4/2010 | Watson | 224/580 |
| 2011/0057004 | A1 | 3/2011 | Anderson | |
| 2012/0085804 | A1 | 4/2012 | Christy | |

OTHER PUBLICATIONS

U.S. Appl. No. 13/719,194, filed Dec. 18, 2012.
Extended European Search Report, Application No. EP 12 82 5149, European Patent Office, dated Aug. 25, 2015.

* cited by examiner

RECREATIONAL BOARD CARRIER

CROSS-REFERENCE TO RELATED APPLICATIONS

This application claims priority to U.S. Provisional Application No. 61/525,550, filed Aug. 19, 2011, and entitled BACKPACK FOR VERTICALLY TRANSPORTING A SURFBOARD, the entire contents of which are hereby incorporated by reference.

BACKGROUND

Recreational boards are conventionally carried and transported under the user's arm, over the head, or strapped over the shoulder. Conventional methods of carrying and transporting a recreational board present several drawbacks.

Typically, carrying or transporting a recreational board encumbers the user's hands and arms, thereby preventing the user from walking while carrying other equipment, riding a bicycle, or otherwise multitasking. Furthermore, the typically horizontal or diagonal position of the recreational board and its distance from the user's center of gravity may each create a moment on the user's back, arm, hand, or other muscles, thereby leading to rapid tension and fatigue. Additionally, carrying the recreational board in a horizontal or diagonal orientation encumbers the maneuverability of the user in close quarters and requires additional clearance for the recreational board. Furthermore, the board can be exposed to damage from nearby objects.

SUMMARY

According to at least one exemplary embodiment, a recreational board carrier is disclosed. The carrier can include a central portion, at least one longitudinal strap coupled to the central portion and extending therefrom, a coupler disposed at a distal end of the longitudinal strap, the coupler adapted to couple to a first end of a recreational board, a plurality of apertures defined in the longitudinal strap, and at least one carrying strap coupled to the central portion.

According to another exemplary embodiment, a recreational board carrier is disclosed. The carrier can include a central portion, at least one longitudinal retaining strap having a proximal end coupled to the central portion and a distal end extending away from the central portion, the distal end adapted to couple to a first end of a recreational board, and at least one carrying strap coupled to the central portion, wherein the at least one longitudinal retaining strap is adapted to encircle a portion of the recreational board substantially parallel the longitudinal axis of the recreational board.

BRIEF DESCRIPTION OF THE FIGURES

Advantages of embodiments of the present invention will be apparent from the following detailed description of the exemplary embodiments. The following detailed description should be considered in conjunction with the accompanying figures in which.

DETAILED DESCRIPTION

Figure 1:
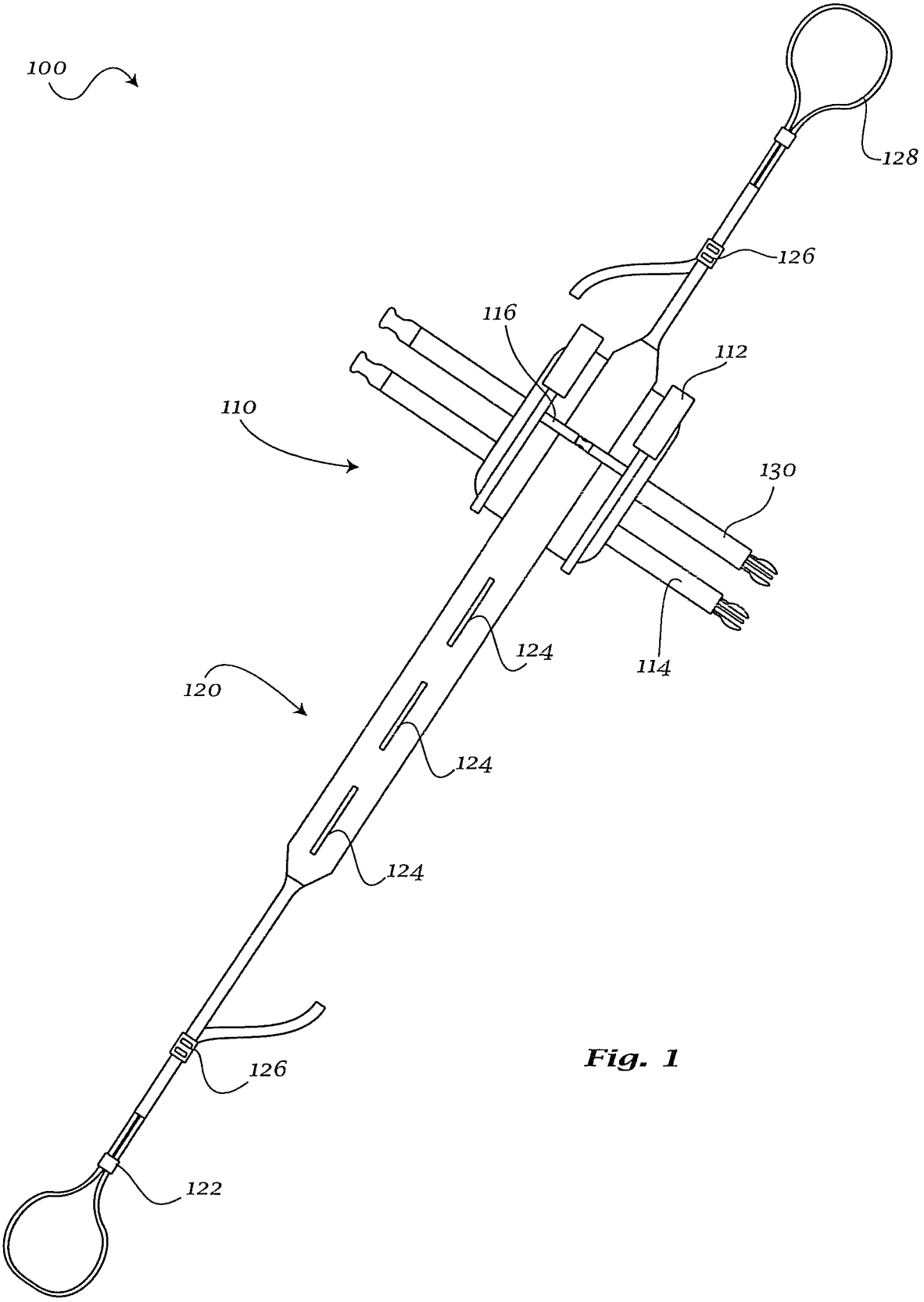
FIG. 1 is a rear view of a first exemplary embodiment of a recreational board carrier.
Figure 2:
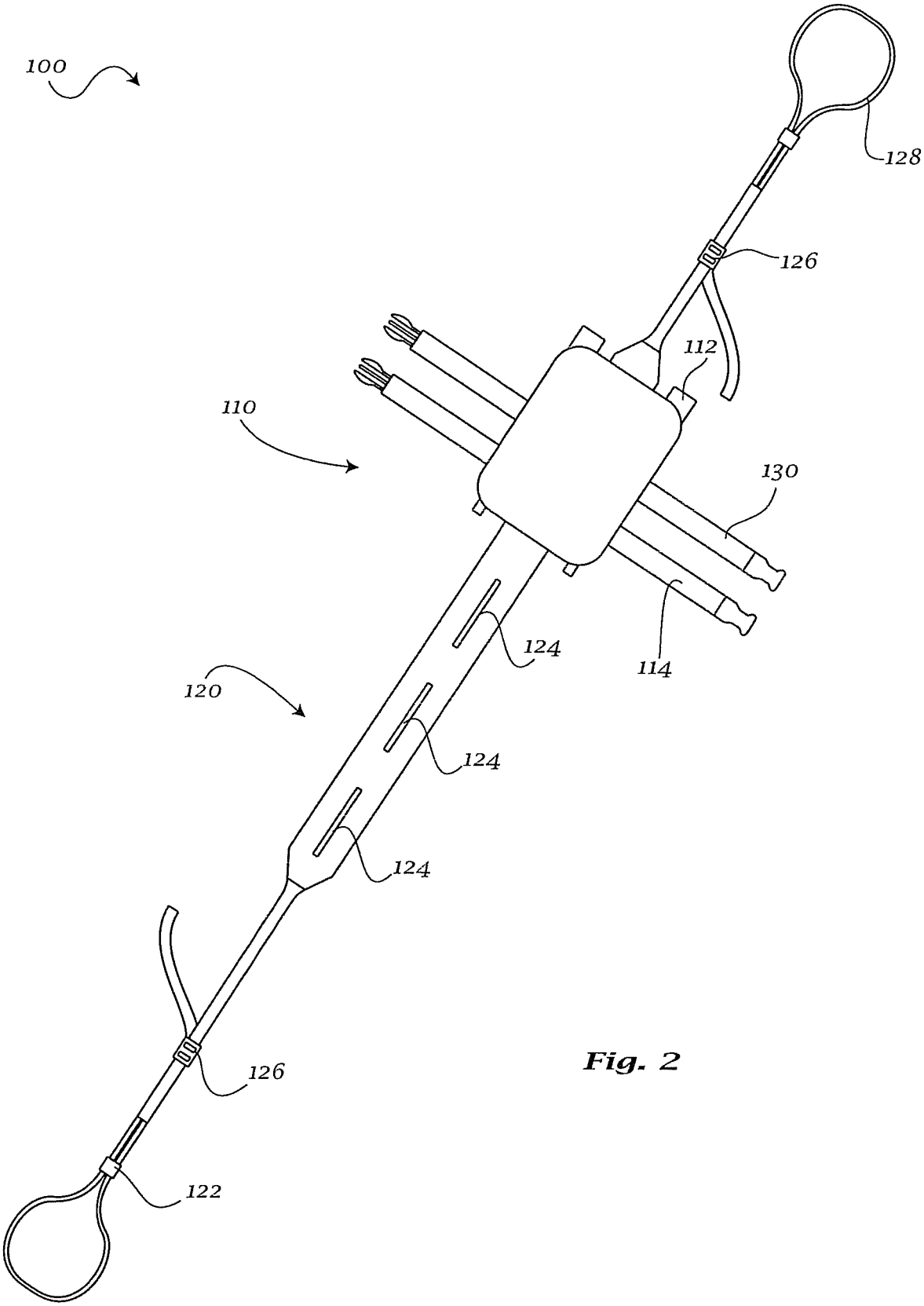
FIG. 2 is a front view of a first exemplary embodiment of a recreational board carrier.
Figure 3:
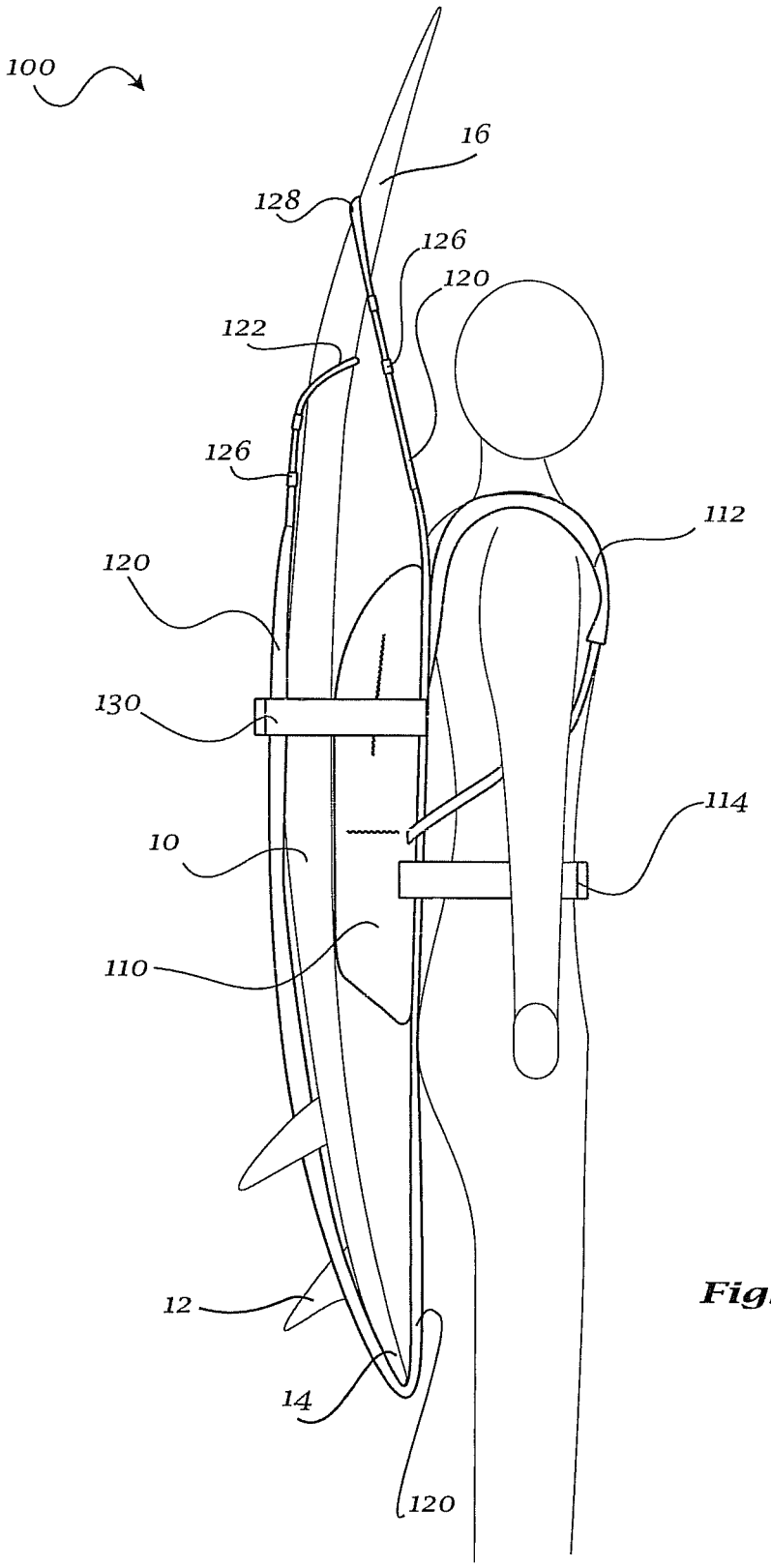
FIG. 3 is a side view of a first exemplary embodiment of a recreational board carrier in use.
Figure 4A:
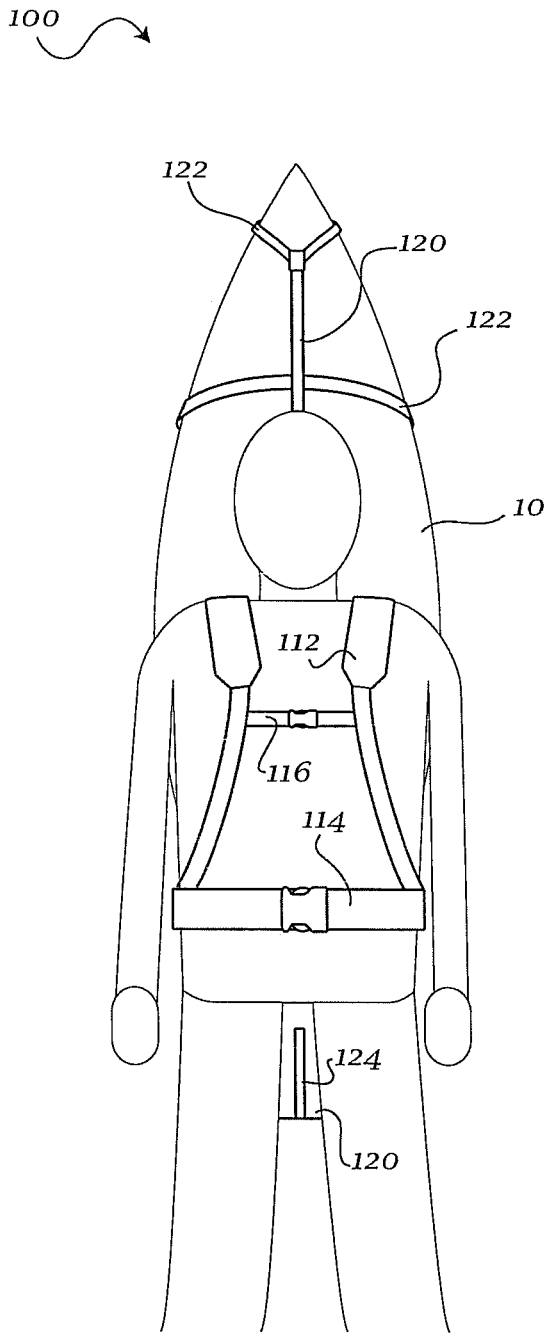
FIGS. 4*a*-4*b* are front and rear views of a first exemplary embodiment of a recreational board carrier in use.
Figure 4B:
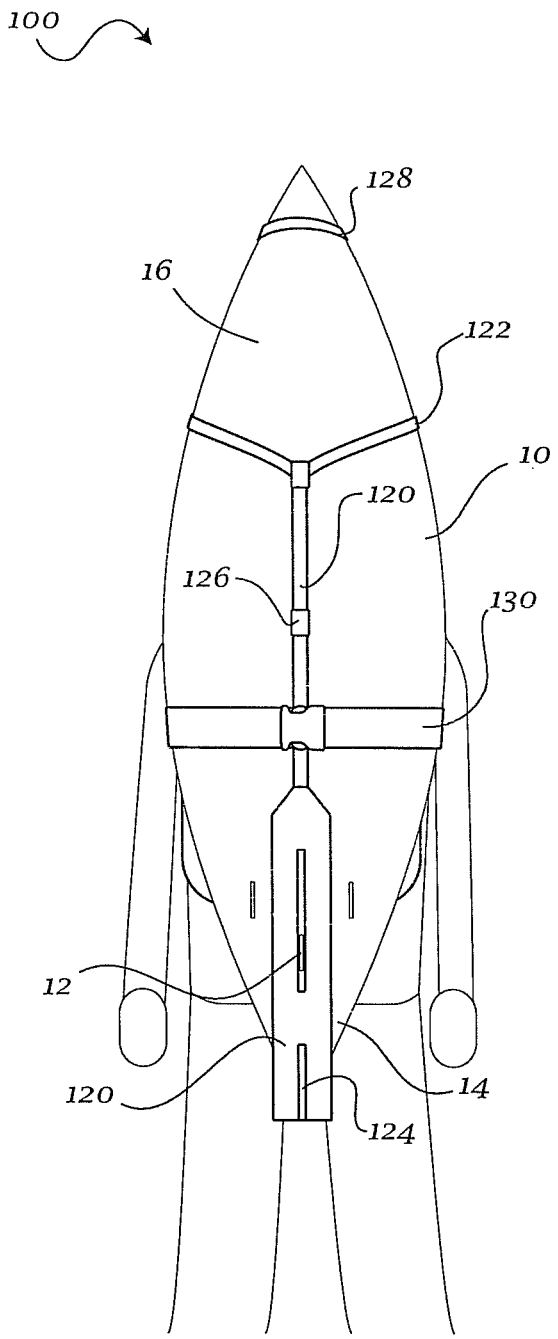
Figure 5:
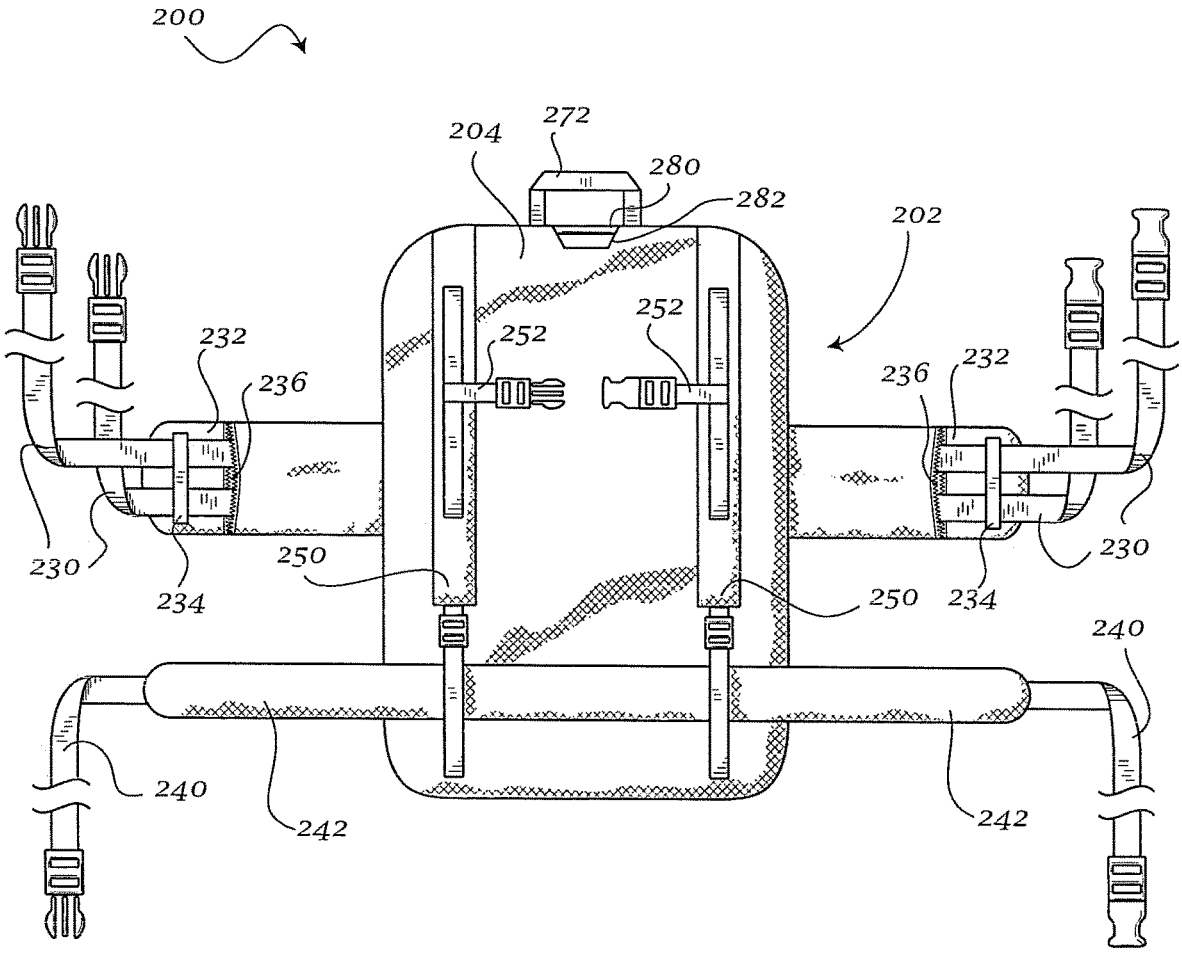
FIG. 5 is a rear view of a second exemplary embodiment of a recreational board carrier.

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description discussion of several terms used herein follows.

As used herein, the word "exemplary" means "serving as an example, instance or illustration." The embodiments described herein are not limiting, but rather are exemplary only. It should be understood that the described embodiment are not necessarily to be construed as preferred or advantageous over other embodiments. Moreover, the terms "embodiments of the invention", "embodiments" or "invention" do not require that all embodiments of the invention include the discussed feature, advantage or mode of operation.

Embodiments disclosed herein describe carriers that can transport a surfboard, snowboard, or similar elongated recreational boards in a substantially vertical position, thereby allowing the user's hands to be free while transporting the board. Embodiments of carriers disclosed herein can further allow the user to carry other equipment, ride a bicycle or other vehicle, or otherwise multitask while transporting the recreational board. The recreational board may be securely strapped and carried behind the user's back in a substantially vertical position, thereby allowing the user to maneuver in narrow spaces and diminishing the risk of damage to the board resulting from contact with objects at the sides of the user. Further, the carrying the surfboard vertically against the user's back may significantly reduce the discomfort caused by conventional methods of carrying a surfboard. By keeping most of the mass of the surfboard horizontally close to the center of gravity of the user, the moment induced on the user's back, arm, hand or other muscles is diminished, thereby reducing tension and fatigue.

In addition to providing novel ways of carrying and transporting a surfboard, the embodiments disclosed herein may allow the user to store additional equipment, thereby eliminating the need for additional straps or board bags.

FIGS. 1-4 show an exemplary embodiment 100 of a recreational board carrier 100. The carrier may include a central portion 110, which may be coupled to a longitudinal strap 120 and a lateral strap 130. Central portion 110 may further include a pair of shoulder harnesses 112, a waist strap 114, and a chest strap 116. The shoulder harnesses 112, the waist belt 114 and the chest belt 116 may facilitate attaching the carrier to the user.

Central portion 110 may be a cushioned member having a depth, so as to provide clearance between a recreational board 10 and the body of the user when carrier 100 is worn. In some exemplary embodiments, central portion 110 may further include at least one storage compartment.

In the exemplary embodiment, the longitudinal strap 120 may be positioned along a central longitudinal axis of the carrier 100. A first end of the longitudinal strap 120 may extend from substantially the lower end of the central portion 110, while a second end of the longitudinal strap 120 may extend from substantially the upper end of the central portion 110. The first end of vertical strap 120 may each include a first adjustable loop 122, and the second end of vertical strap 120 may include a second adjustable loop 128. The diameters of adjustable loops 122, 128 may be adjusted using, for example, a slide & locking coupler, or using any other adjusting mechanism known in the art.

Vertical strap 120 may include at least one aperture 124, and may have a length that can accommodate various surfboard sizes, various user heights, and to allow adjustment of the height of the surfboard relative to the user. Aperture 124 may have any desired shape, for example a rectangular shape, and may receive a fin 12 of a recreational board 10. The apertures 124 may further be reinforced, so as to receive an end of the recreational board 10. In some embodiments, apertures 124 may have a substantially diamond-like shape to facilitate reinforcement.

The longitudinal strap 120 may further be fitted with adjustment buckles 126. The adjustment buckles 126 may facilitate varying the length of the vertical strap 120. The lateral strap 130 may extend laterally from the central portion 110. Horizontal strap 130, waist strap 114, and chest strap 116 may be fastened using a set of conventional backpack buckles, hook-and-loop fasteners, or any other fastening method known in the art. Horizontal strap 130, the shoulder harnesses 112, waist strap 114, and chest strap 116 may be constructed from any material known in the art.

In operation, the user may place the recreational board on the central portion 110 of the carrier, and may encircle the longitudinal strap 120 around a first end 14 of the recreational board 10. The user may further place an end or a fin 12 of the recreational board within the at least one aperture 124. The user may then attach adjustable loop 122 to a second end 16 of the recreational board. Subsequently, the user may encircle the horizontal strap 130 around the recreational board, and may further attach adjustable loop 128 to the second end 16 of the recreational board, so as to facilitate stability. The carrier 100 may then be donned and secured to the user utilizing the shoulder harnesses 112, the waist belt 114 and the chest belt 116.

FIGS. 5-8*d* show another exemplary embodiment of a recreational board carrier 200. Carrier 200 may include a backpack portion 202, which may be coupled to at least one longitudinal retaining strap 220. Backpack portion 202 may further include at least one lateral retaining strap 230, at least one waist strap 240, and a pair of shoulder straps 250. Waist and shoulder straps 240, 250 can facilitate coupling carrier 200 to a user such that backpack portion 202 is disposed substantially adjacent the back of the user when carrier 200 is worn. Retaining straps 220, 230 can facilitate coupling a recreational board 20 to carrier 200 such that the recreational board is oriented in a substantially vertical position when carrier 200 is worn. Furthermore, one or more of retaining straps 220, 230 may be decoupleable from backpack portion 202, and/or stowable within backpack portion 202 so as to allow carrier 202 to be used as a backpack when it is not desirable to transport a recreational board.

Backpack portion 202 of carrier 200 can include a rear face 204, a front face 206, and a pair of side faces 208 extending between and coupled to front face 206 and rear face 204. Rear face 204 can be disposed adjacent the user's back when carrier 200 is worn. Rear face 204 may be substantially flat, and may include padding to facilitate increased comfort for the user when carrier 200 is worn. Front face 206 may have a substantially flat portion, and may include curved or angled portions substantially at the top and bottom thereof, allowing front face 204 and rear face 206 to be coupled to each other at the top and bottom ends of backpack portion 202. Alternatively, any known shape or configuration for backpack portion 202 that allows carrier 200 to function as described herein may be contemplated and provided as desired.

A pair of shoulder straps 250 can be coupled to backpack portion 202, allowing the carrier to be worn as a backpack by the user. The shoulder straps can extend from substantially proximate the upper portion of rear face 204 to substantially the lower portion of rear face 204, or can be disposed in any way that allows carrier 202 to function as described herein. A chest strap 252 can be coupled to and extend between shoulder straps 250, allowing the user to decrease the distance between the shoulder straps, thereby maintaining the carrier snug against the user's body when the carrier is used with a recreational board or another object having substantial weight. Chest strap 252 may be positioned such that it extends substantially across the user's chest when the carrier is worn.

A waist strap 240 may be coupled to backpack portion 202, allowing the user to maintain carrier 200 snug against the user's body when the carrier is used with a recreational board or another object having substantial weight, and to reduce the likelihood of any sliding, bouncing, or other undesirable movements of carrier 200. Waist strap 240 may be disposed such that it extends substantially across the waist of the user when carrier 200 is worn. Waist strap 240 can include a wide section 242 which may enclose a portion of waist strap 240. Wide section 242 can facilitate distributing the pressure of waist strap 240 over a larger area of the user's body and can further include padding disposed between waist strap 240 and the user's body, thereby increasing comfort to the user when waist strap 240 is used.

At least one lateral retaining strap 230 may be coupled to backpack portion 202. The at least one lateral retaining strap 230 may be coupled to the side faces 208 or to the front face 206 of the backpack portion, or substantially at the interface between the side and front faces. The at least one lateral retaining strap 230 can extend across a surface of the recreational board, substantially perpendicularly to the longitudinal axis of the recreational board, so as to retain the recreational board between the front face 206 of backpack portion 202 and the at least one lateral retaining strap 230. The at least one lateral retaining strap 230 can further reduce the likelihood of lateral movement of the recreational board, such that the recreational board remains in a substantially vertical position while it is being carried. A wide section 232 may be provided so as to increase the portion of the recreational board enclosed by the at least one lateral retaining strap 230 and to increase the area over which the pressure of at least one lateral retaining strap 230 is distributed. Wide section 232 can further enclose a portion of at least one lateral retaining strap 230, and can include fasteners 234, for example loops, through which at least one lateral retaining strap may be received, thereby maintaining the retaining strap coupled to the wide section. Additionally, wide section 232 can include pockets 236, within which the at least one retaining strap 230 may be stored when not in use. Furthermore, when retaining straps 230 are not in use, wide sections 232 can be coupled to each other by means of fasteners, for example such as hook-and-loop fasteners, disposed on the surfaces thereof.

Portions of front face 206 and the surfaces of wide sections 232 that contact the recreational board can include a material 286 having increased grip and non-skid properties. An example of such a material can be the "Slip-Not Grip Fabric" manufactured by Eastex Products, Inc. However, any material having analogous functionality may be contemplated and provided as desired.

Figure 6A:
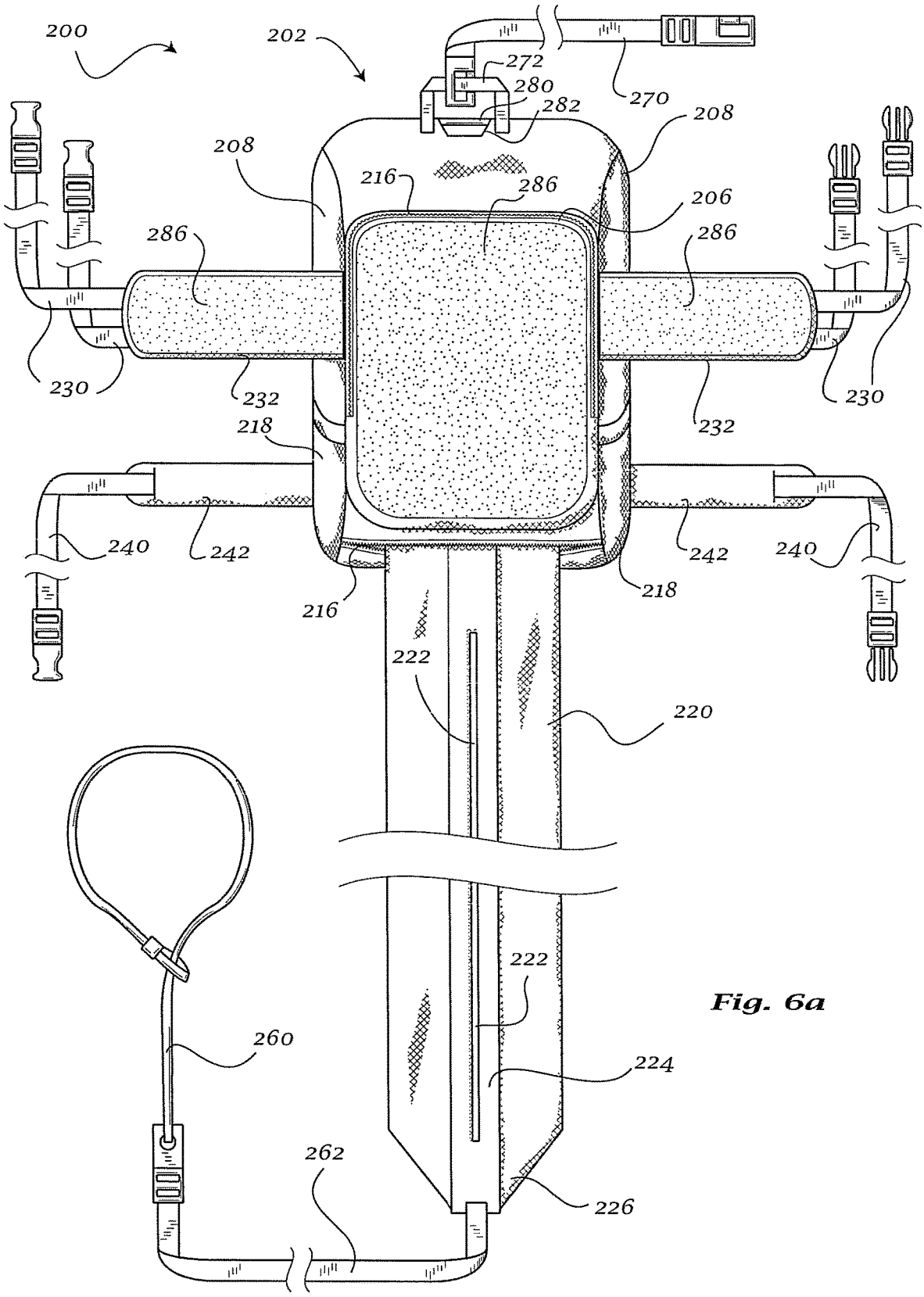
FIGS. 6*a*-6*b* are a front view of a second exemplary embodiment of a recreational board carrier.
Figure 7A:
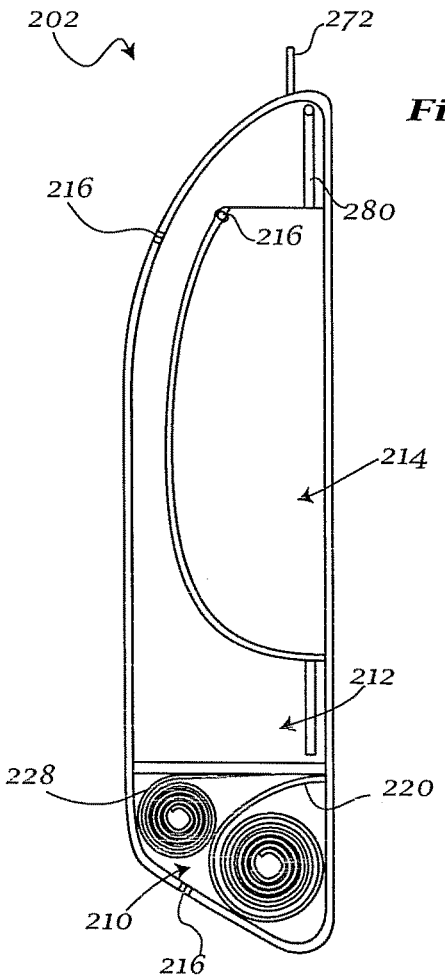
FIG. 7*a* is a cross-sectional schematic view of a second exemplary embodiment of a recreational board carrier.

Carrier 200 can further include a first longitudinal retaining strap 220, as shown in FIG. 6*a*. First longitudinal strap 220 can be coupled to backpack portion 202 substantially at the lower end of the backpack portion. Furthermore, longitudinal retaining strap 220 can be disposed within a strap storage compartment 210, which may be disposed substantially at the bottom of backpack portion 202. The strap storage compartment 210 can be sized and shaped to allow longitudinal retaining strap to be stored in the compartment, for example in a rolled up, folded, or other compact configuration, as shown in FIG. 7*a*. Strap storage compartment 210 can further include a closure 216, which may be a zipper or any other known closure.

Figure 8A:
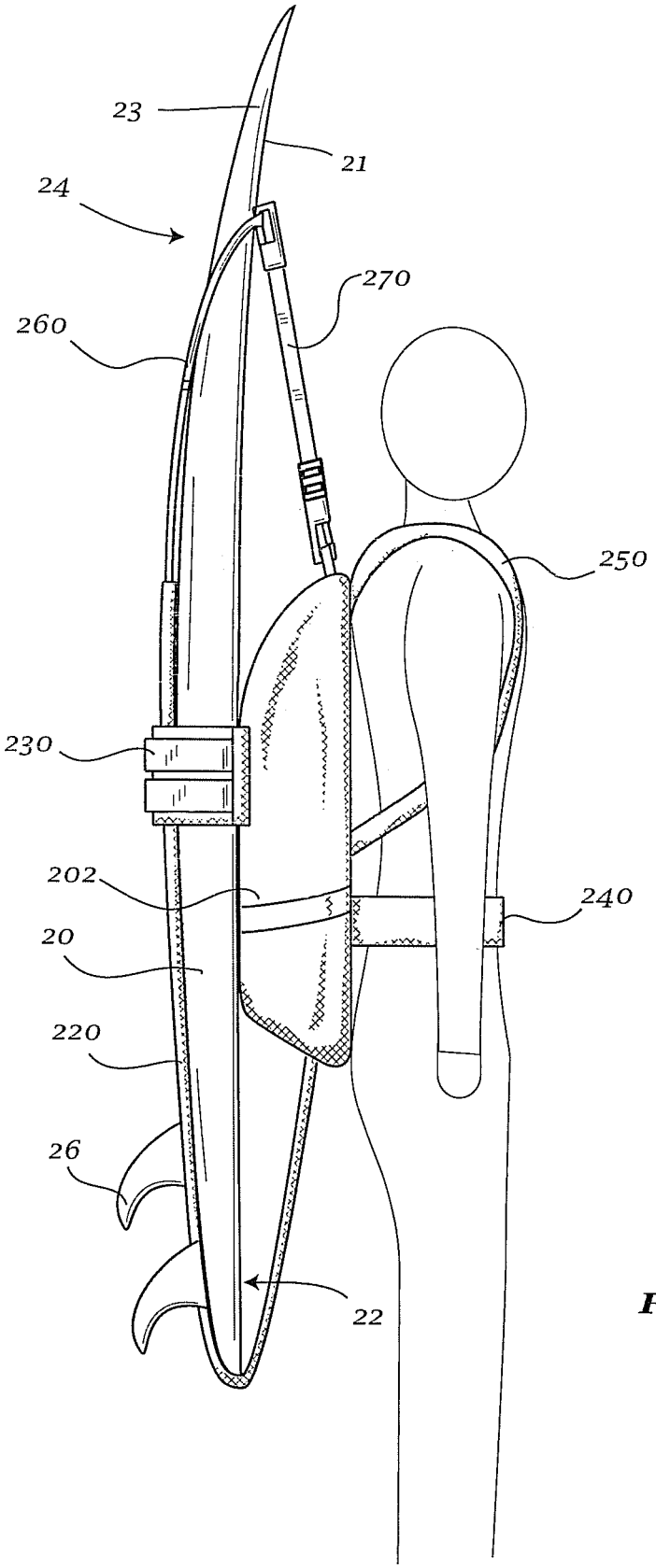
FIGS. 8*a*-8*d* are views of a second exemplary embodiment of a recreational board carrier in use.
Figure 8B:
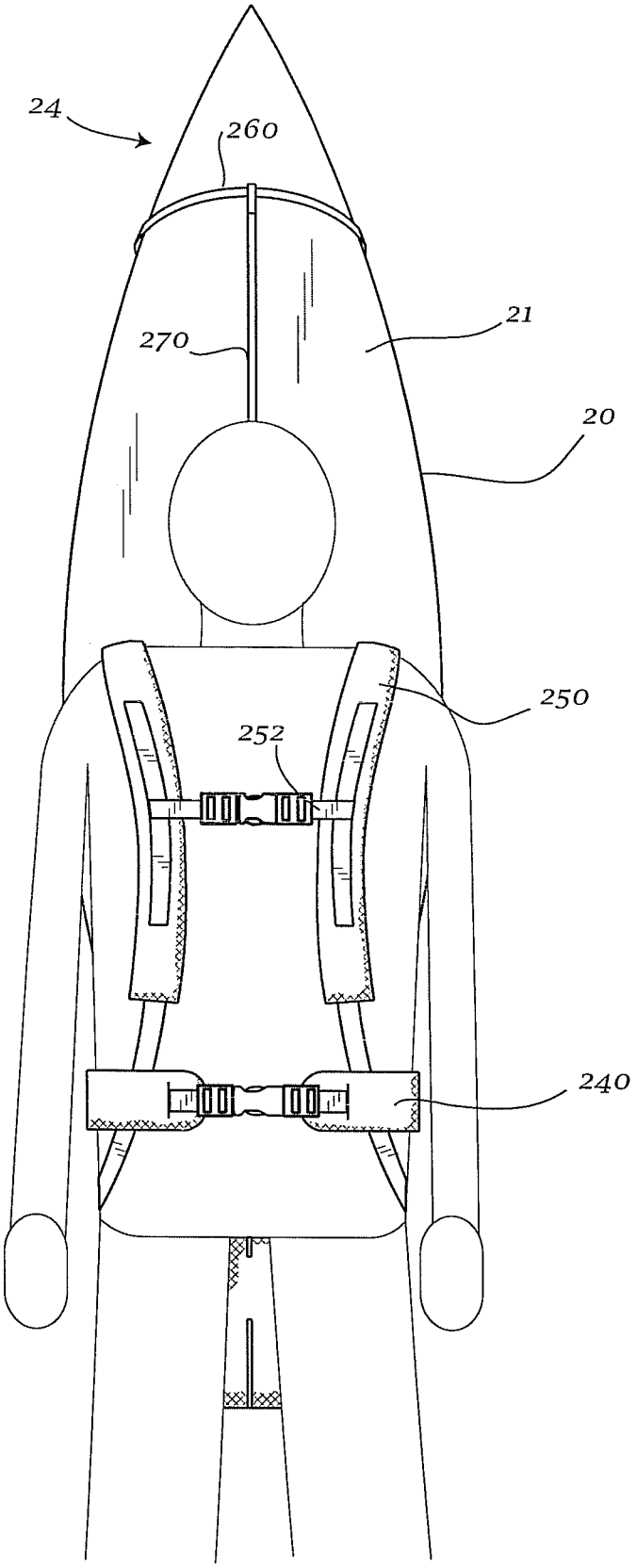
Figure 8C:
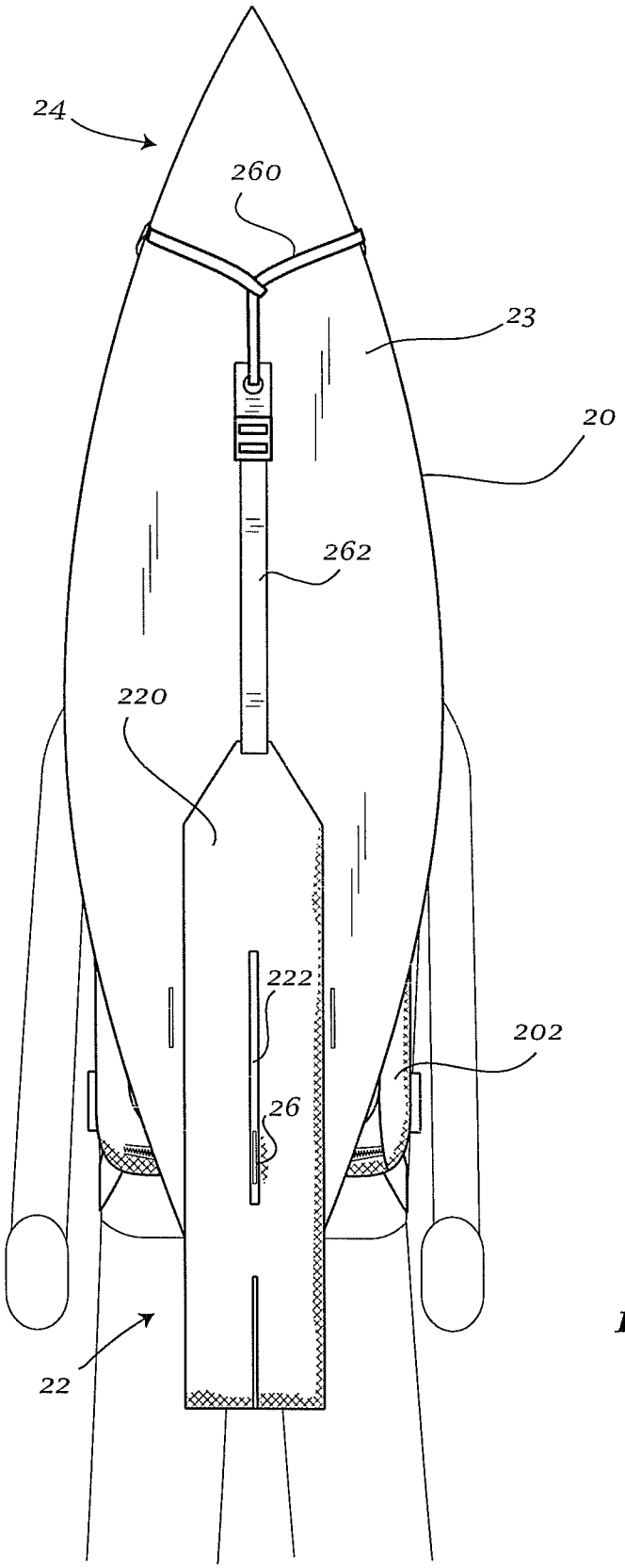

The length of first longitudinal strap 220 can be sufficient so as to extend from backpack portion 202, around a lower end 22 of recreational board 20, and across a portion of a surface of the recreational board 20, substantially as shown in FIGS. 8*b*-8*c*. Exemplary measurements for first longitudinal strap 220 can be about 8 feet in length, with a width of about 10 inches tapering to a width of about one inch at distal end 226.

At least one aperture 222 may be provided within first longitudinal strap 220. The at least one aperture 222 may extend along the longitudinal axis of strap 220, and may be sized and shaped to receive a tail or fin 26 of the recreational board 20. Aperture 222 may have any shape that enables carrier 200 to function as described herein, for example a rectangular shape. Aperture 222 may further be reinforced. To that end, a reinforcement strip 224 providing additional thickness and reinforcement may extend along the longitudinal axis of strap 220. Furthermore, any configuration that can facilitate reinforcement of aperture 222 can be contemplated and provided as desired.

Coupled to the distal end 226 of first longitudinal strap 220 may be a loop 260. Loop 260 may be sized and shaped to encircle an upper end 24 of a recreational board 20. Loop 260 may be coupled to first longitudinal strap 220 via an intermediate strap 262, the length of which may be adjustable, so as to adapt carrier 200 for recreational boards of various sizes. Exemplary measurements for loop 260 may be about 42 inches in length.

Figure 6B:
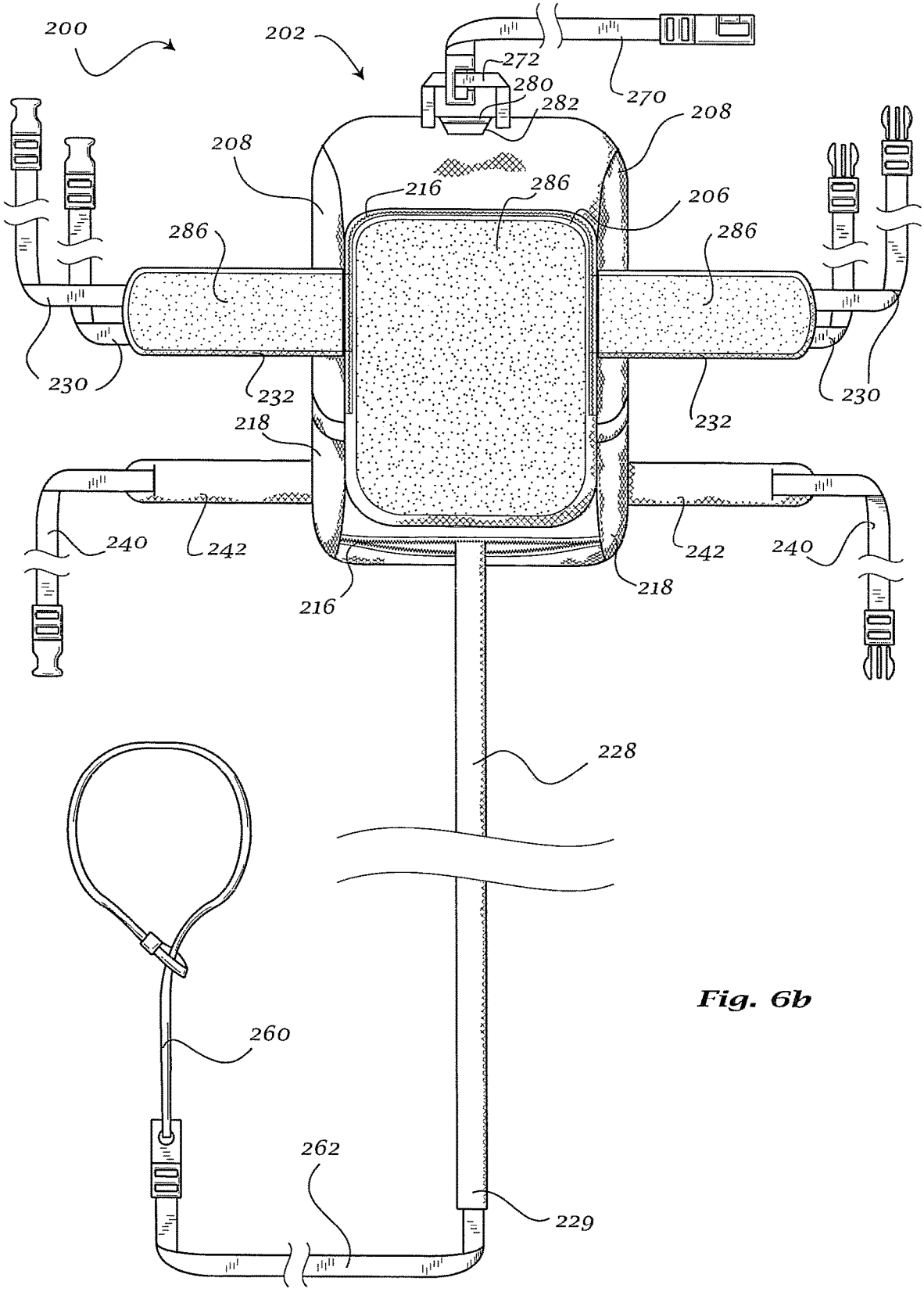

In some exemplary embodiments, carrier 200 can further include a second longitudinal retaining strap 228, as shown in FIG. 6*b*. Second longitudinal strap 228 can be coupled to backpack portion 202 substantially at the lower end of the backpack portion. Furthermore, second longitudinal retaining strap 228 can be disposed within a strap storage compartment 210, which may be disposed substantially at the bottom of backpack portion 202. The strap storage compartment can be sized and shaped to allow both longitudinal retaining straps 220, 228 to be stored in the compartment, for example in a rolled up, folded, or other compact configuration, as shown in FIG. 7. Strap storage compartment 210 can further include a closure 216, which may be a zipper or any other known closure.

Figure 8D:
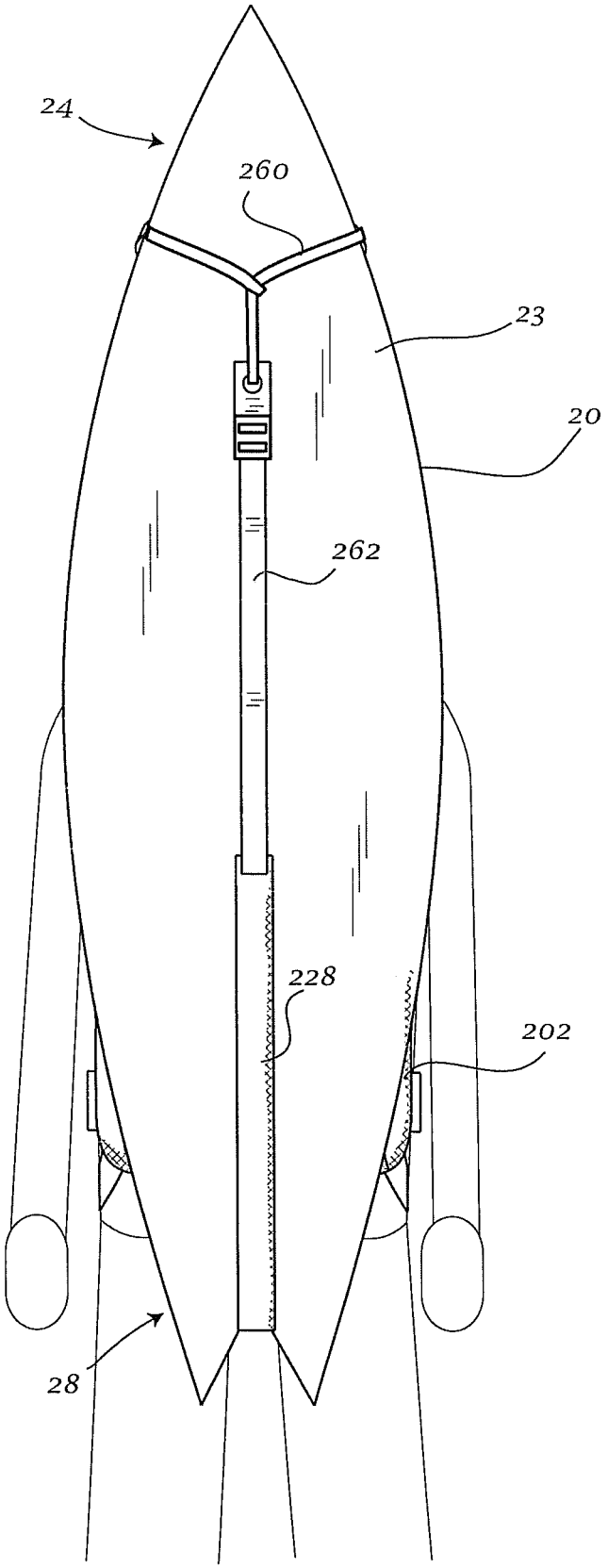

Second longitudinal strap 228 can be adapted to carry recreational boards having a bifurcated end, for example a swallowtail surfboard. The length of strip 228 can be sufficient so as to extend from backpack portion 202, around a bifurcated end 28 of recreational board 20, and across a portion of a surface of the recreational board 20, substantially as shown in FIG. 8*d*. Furthermore, second strap 228 can have a width that allows strap 228 to be disposed within the bifurcated end 228 of recreational board 20. Exemplary measurements for second longitudinal strap 228 can be about 8 feet in length, with a width of about 1 inch.

Coupled to the distal end 229 of second longitudinal strap 228 may be an adjustable loop 260. Loop 260 may be sized and shaped to encircle an upper end 24 of a recreational board 20. Loop 260 may be coupled to second longitudinal strap 228 via an intermediate strap 262, the length of which may be adjustable, so as to adapt carrier 200 for recreational boards of various sizes. Exemplary measurements for loop 260 may be about 42 inches in length. Loop 260 may be adjustable using any desired structure, for example a slide adjuster, which can allow the user to vary the diameter of loop 260 so as to fit a desired size of recreational board.

Carrier 200 may further include a hanging loop 272. Hanging loop 272 may be used to suspend carrier 200 from hooks, doorknobs, and so forth. Carrier 200 may also include a tensioning strap 270. Tensioning strap 270 may be coupled to backpack portion 202, for example substantially at the upper end of the backpack portion. For example, one end of tensioning strap 270 may be attached to hanging loop 272. A second end of tensioning strap 270 may be coupled to loop 260 when loop 260 is disposed around an upper end 24 of a recreational board 20. Tensioning strap 260 may be used if desired to maintain the upper end 24 of a large recreational board 20 in tensioned relation to carrier 200, thereby reducing the likelihood of movement of the upper end of the recreational board. However, it should be appreciated that carrier 200 may be used to carry a recreational board without the use of tensioning strap 270.

Backpack portion 202 can include a plurality of compartments therein, for example a strap storage compartment 210, a wet storage compartment 212, and a dry storage compartment 214. Wet storage compartment 212 and dry storage compartment 214 can facilitate separating wet items, such as wetsuits, from dry items carried within backpack portion 202. The compartments may include further include closures 216, which may be a zipper, a pull string, or any other known closure. Backpack portion 202 can further include external storage compartments, for example, pockets 218. Additional compartments, pockets, or any other known storage or object carrying structures may be contemplated and provided as desired.

It should be appreciated that the straps and loops 228, 230, 240, 250, 252, 260, 270, as well as the adjustable described above can include any desired coupling structures for fastening the straps. Such coupling structures can include buckles, clips, hook and loop fasteners, or any other known coupling structure that enables carrier 200 to function as described herein. It should further be appreciated that the straps and loops 228, 230, 240, 250, 252, 260, 270 described above can include length adjusting structures for varying the lengths of the straps. Such length adjusting structures can include strap adjusters, tri-glide buckles, or any other known strap length adjusting structure that enables carrier 200 to function as described herein. The coupling structures and length adjusting structures may be provided as a unit, or independently on desired straps.

Figure 7B:
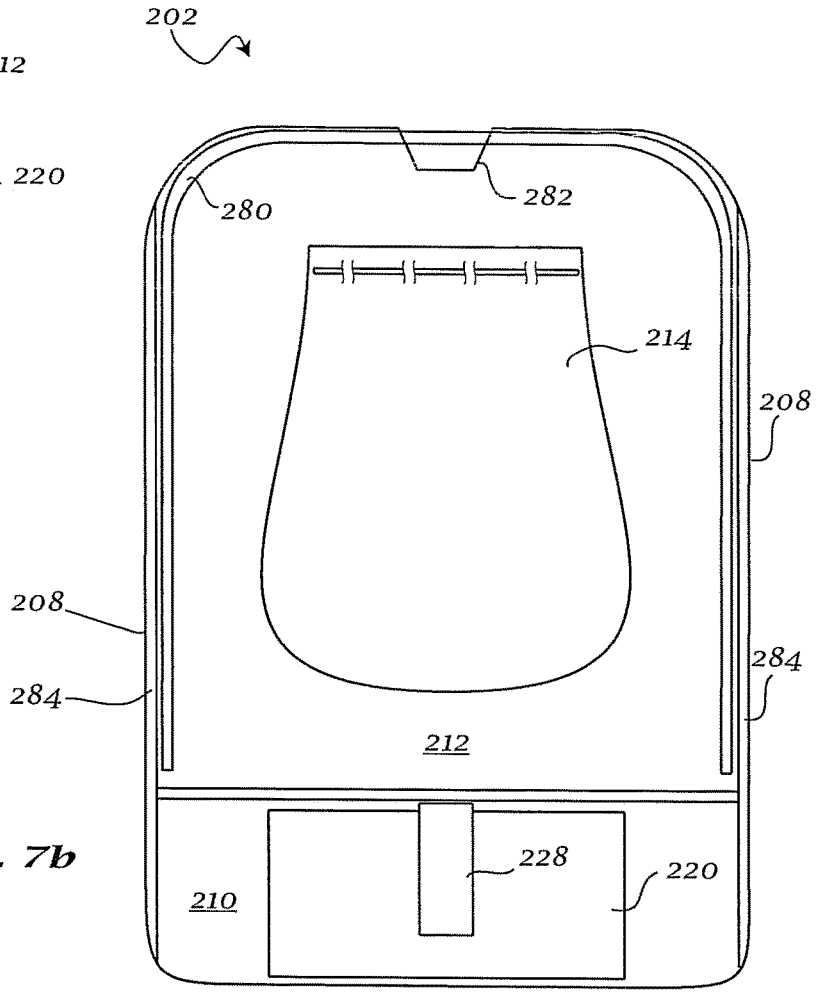
FIG. 7*b* is a frontal schematic view of the interior of a second exemplary embodiment of a recreational board carrier.

In some exemplary embodiments, rigidity and shape may be provided to backpack portion 202 by reinforcing member 280 and reinforcing panels 284. Reinforcing member 280 may be substantially U-shaped, and can extend along the perimeter of the interior of backpack portion 202. Reinforcing member 280 can extend from a first side of the lower end of the interior of backpack portion 202, across the upper end of the backpack portion, and down to a second side of the lower end of the backpack portion, as shown in FIG. 7*b*. Reinforcing member 280 can impart top-to-bottom rigidity to backpack portion 202, for example by preventing the upper end of the backpack portion from collapsing toward the bottom end. Furthermore, a portion of reinforcing member 280 can be exposed to the exterior, for example via a notch 282 disposed substantially at the upper end of carrier 200. An exemplary size for notch 282 may be about 1 inch square. This arrangement can provide a theft deterrence capability to carrier 200. For example, the user may affix a bike lock, chain, U-lock, or the like to the portion of reinforcing member 280 that is exposed within notch 282. If the reinforcing member 280 is cut so as to remove the lock, the integrity of backpack portion 202 can be compromised, thereby impeding the usability of carrier 200.

In some exemplary embodiments, front-to-back rigidity may be provided to backpack portion 202 by reinforcing panels 284, as shown in FIG. 7*b*. Reinforcing panels 284 may be disposed adjacent the side faces 208 of backpack portion 202 and may have substantially the same shape as side faces 208. Reinforcing panes 284 may be formed from any rigid material that allows carrier 200 to function as described herein.

It should further be appreciated that the components of carrier 200 may be faulted from any known materials and coupled using any known methods that allow carrier 200 to function as described herein.

Referring now to FIGS. 8*a*-8*d*, in operation, a user may place carrier 200 in a convenient position, for example such that the rear face 204 of backpack portion 202 is adjacent a supporting surface, such as the ground. The user may then place a recreational board 20 such that a first face 21 of the recreational board is disposed adjacent the front face 206 of backpack portion 202. Subsequently, the user may encircle a longitudinal strap 220 or 228 around a lower end 22 or 28 of the recreational board such that a portion of the strap is disposed proximate to a second face 23 of the recreational board. The user may then encircle loop 260 around an upper end 24 of the recreational board, and adjust the length of intermediate strap 260 such that loop 260, intermediate strap 262 and longitudinal strap 220 or 228 are substantially taut. The user may also encircle at least one lateral retaining strap 230 around recreational board 20 such that the at least one lateral retaining strap 230 is disposed proximate second face 23 of the recreational board, and adjust the length of the at least one lateral retaining strap 230 such that strap 230 is taut. If desired, the user may also extend tensioning strap 270 between backpack portion 202 and loop 260, and adjust the length of the tensioning strap such that the strap 270 is taut.

When coupling a recreational board having a central fin 26 disposed on a surface of the board, the user may insert the fin 26 through one of the plurality of apertures 222 defined in longitudinal retaining strap 220. This can allow strap 220 to be disposed proximate the second surface 23 of the recreational board and reduce the likelihood of the fin 26 being bent or damaged due to the tension of strap 220. Furthermore, if a recreational board has a substantially pointed end, that end may also be received within a aperture 222 of first longitudinal retaining strap 220. If the recreational board has a substantially bifurcated end 28, second longitudinal strap 228 may be used in lieu of first longitudinal strap 220.

It should be appreciated that carrier 200 can allow the user to affix the recreational board at a variety of heights by choosing the location the length of strap 220/228 that encircles the lower end 22/28 of the recreational board. For example, if the lower end 22/28 of the recreational board is placed close to the end of strap 220/228 that is coupled to backpack portion 202, the recreational board may be substantially elevated when the carrier is worn. Conversely, if the lower end 22/28 of the recreational board is placed close to the distal end 226/229 of strap 220/228, the recreational board may be positioned closer to the ground when carrier 200 is worn. The length of loop 260 can then be adjusted accordingly. This variability can allow the user to select a comfortable elevation for the board, allowing carrier 200 to be used with boards of varying sizes and weights, and by users of varying heights, as well as providing desired clearances between the board and the environment, for example when riding a bicycle or walking through areas with ceilings.

After the recreational board 20 is fastened to carrier 200, the user may don the carrier, utilizing shoulder straps 250 to transport carrier 200 as a backpack. The user may also fasten chest strap 252 and waist strap 240 and adjust the lengths thereof as desired to provide further stability to carrier 200 and comfort to the user. The user can then easily and comfortably transport the recreational board using carrier 200, while performing diverse activities such as walking, bicycling, and so forth.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A recreational board carrier, comprising:

a central portion with a bottom and a top;

at least one longitudinal strap coupled in fixed relation to the central portion with a first distal end extending up from the top of the central portion and a second distal end extending down from the bottom of the central portion;

a coupling member disposed at the first distal end of the longitudinal strap, the coupling member constructed to couple proximate to a first end of a recreational board above the top of the central portion;

a second coupling member disposed at the second distal end of the longitudinal strap and constructed to couple to an end of a recreational board;

wherein the second distal end of the at least one longitudinal strap is constructed to extend down from the bottom of the central portion along a longitudinal axis of a first side of the recreation board and wrap under a second end of the recreational board and extend back up the longitudinal axis on an opposite side of the recreation board past the top of the central portion so that the second coupling member can to couple to the recreational board proximate to the first end; and at least one carrying strap coupled to the central portion.

2. The recreational board carrier of claim 1, further comprising:

at least one lateral strap coupled to the central portion and designed to encircle a recreational board.

3. The recreational board carrier of claim 1, wherein the carrier is configured to orient the recreational board substantially vertically when the carrier is worn by a user.

4. The recreational board carrier of claim 1, wherein the longitudinal strap includes at least one aperture along a length of the longitudinal strap designed to receive a fin from a surfboard.

5. The recreational board carrier of claim 1, wherein the central portion includes at least one storage compartment.

6. The recreational board carrier of claim 5, wherein the at least one longitudinal strap is storable within the at least one storage compartment.

7. The recreational board carrier of claim 4, wherein the longitudinal strap includes a plurality of apertures along the length of the longitudinal strap each designed to receive a fin from a surfboard.

8. The recreational board carrier of claim 1, wherein the recreational board is a surfboard.

9. The recreational board carrier of claim 1, wherein the coupling member is designed to couple to the second coupling member when supporting a recreational board.

10. The recreational board carrier of claim 1, wherein the central portion is a shell with a substantially hollow interior and a resealable opening designed to allow access to the interior.

11. A recreational board carrier, comprising:

a central portion with a top and a bottom;

a first longitudinal strap having a proximal end coupled in fixed relation to the central portion and a distal end designed to extend away from the bottom of the central portion parallel to a longitudinal axis of a recreational board down along a first side of the recreation board and wrap under a bottom of the recreational board and extend back up an opposite side of the recreation board past the top of the central portion to a first end of the recreational board;

a first coupling member attached to the distal end of the first longitudinal strap and constructed to couple to the first end of a recreational board;

at least one carrying strap coupled to the central portion; and a second longitudinal strap having a proximal end coupled in fixed relation to the central portion, and a distal end constructed to extend away from the top of the central portion and couple proximate to the first end of a recreational board above the central portion.

12. The recreational board carrier of claim 11, further comprising: at least one lateral retaining strap coupled to the central portion;

wherein the at least one lateral retaining strap is constructed to encircle a portion of the recreational board substantially perpendicular to the longitudinal axis of the recreational board.

13. The recreational board carrier of claim 11, wherein the carrier is configured to orient the recreational board substantially vertically when the carrier is worn by a user.

14. The recreational board carrier of claim 11, wherein at least one of the first or the second longitudinal straps is a tensioning strap.

15. The recreational board carrier of claim 11, wherein the central portion includes at least one storage compartment.

16. The recreational board carrier of claim 15, wherein at least one of the first and second longitudinal straps is storable within the at least one storage compartment.

17. The recreational board carrier of claim 11, wherein the first longitudinal strap includes at least one aperture positioned along a length of the first longitudinal strap and wherein the at least one aperture is designed to receive a fin from a surfboard.

18. The recreational board carrier of claim 11, wherein the central portion comprises:

a substantially hollow shell with a front, a back, and two side faces, wherein the back is designed to be coupled to a back of a user;

reinforcing panels coupled adjacent the side faces of the substantially hollow shell.

19. The recreational board carrier of claim 17, wherein the first longitudinal strap includes a plurality of apertures positioned along the length of the first longitudinal strap and wherein the plurality of apertures is each designed to receive a fin from a surfboard.

20. The recreational board carrier of claim 11, wherein the recreational board is a surfboard.

21. The recreational board carrier of claim 11 further comprising a second coupling member attached to the distal end of the second longitudinal strap and constructed to couple to the first coupling member when supporting a recreational board.

22. A surfboard carrier comprising:

a central portion with a bottom and a top;

two shoulder straps coupled to the central portion;

a longitudinal strap coupled to the central portion wherein the longitudinal strap is constructed to extend down from the bottom of the central portion along a longitudinal axis of a first side of the surfboard and wrap under a bottom of the surfboard and extend back up the longitudinal axis on an opposite side of the surfboard such that a distal end of the longitudinal strap extends past the top of the central portion to a nose of the surfboard;

a coupling member disposed at the distal end of the longitudinal strap, the coupling member including a loop constructed to encircle a nose of a surfboard;

at least one lateral retaining strap coupled to the central portion wherein the at least one lateral retaining strap is constructed to encircle a surfboard proximate a midpoint and substantially perpendicular to the longitudinal axis of the surfboard.

23. The surfboard carrier of claim 22 wherein the two should straps, the longitudinal strap, and the lateral retaining strap are all adjustable in length.

24. The surfboard carrier of claim 23 wherein the loop is adjustable in length.

25. The surfboard carrier of claim 22 wherein the surfboard carrier is a backpack and the central portion is a shell including a re-sealable opening.

* * * * *